US011532252B2

(12) United States Patent
Cheng et al.

(10) Patent No.: US 11,532,252 B2
(45) Date of Patent: Dec. 20, 2022

(54) TEST SIGNAL ACCESS BOARD AND LIGHTING JIG

(71) Applicants: Fuzhou BOE Optoelectronics Technology Co., Ltd., Fujian (CN); BOE Technology Group Co., Ltd., Beijing (CN)

(72) Inventors: Wenjin Cheng, Beijing (CN); Yang Yu, Beijing (CN); Zongtian Xie, Beijing (CN); Huoying Fu, Beijing (CN); Huailiang Wu, Beijing (CN)

(73) Assignees: Fuzhou BOE Optoelectronics Technology Co., Ltd., Fujian (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/512,494

(22) Filed: Oct. 27, 2021

(65) Prior Publication Data

US 2022/0284839 A1 Sep. 8, 2022

(30) Foreign Application Priority Data

Mar. 8, 2021 (CN) ..... 202110249719.9

(51) Int. Cl.
*G09G 3/00* (2006.01)

(52) U.S. Cl.
CPC ..... *G09G 3/006* (2013.01); *G09G 2330/12* (2013.01)

(58) Field of Classification Search
CPC ..... G09G 3/006; G09G 2330/12
USPC ..... 324/133, 76.11
See application file for complete search history.

(56) References Cited

U.S. PATENT DOCUMENTS

2006/0111861 A1* 5/2006 Horne ..... G01R 31/31937 702/89
2011/0072326 A1* 3/2011 Vahidsafa ..... G11C 29/32 714/E11.002
2016/0299171 A1* 10/2016 Timm ..... G01R 1/0408

* cited by examiner

*Primary Examiner* — Giovanni Astacio-Oquendo
(74) *Attorney, Agent, or Firm* — IPRO, PLLC

(57) ABSTRACT

Disclosed are a test signal access board and a lighting jig, including: a substrate layer; and a data signal access part arranged on the substrate layer and including at least two rows of conductive contacts, where the conductive contacts are configured to be electrically connected with data signal test leads of a display panel; the conductive contacts in adjacent rows are arranged in a staggered manner; and a staggered pitch between the conductive contacts in adjacent rows is less than a pitch between the data signal test leads of the display panel.

14 Claims, 3 Drawing Sheets

TEST SIGNAL ACCESS BOARD AND LIGHTING JIG

The present disclosure claims the priority from Chinese Patent Application No. 202110249719.9, filed with the Chinese Patent Office on Mar. 8, 2021, and entitled "TEST SIGNAL ACCESS BOARD AND LIGHTING JIG", which is hereby incorporated by reference in its entirety.

FIELD

The present application relates to the technical field of display module detection, in particular to a test signal access board and a lighting jig.

BACKGROUND

Display module test (Cell Test) is a method that a test signal block probe is adopted and a test signal access board is used as a carrier for signal connection to input different electrical signals into a display panel, so that the display panel presents different image pictures to show defects, thereby detecting the defects. With the development of technology, in the liquid crystal display (LCD) industry, gate on array (GOA) architecture technology is mainly adopted for designing a display panel, and therefore when the test signal access board is designed for Cell Test, two solutions, i.e., full contact of signal leads or 2D shorting bar, are mainly selected to load signals.

SUMMARY

The present application provides the following technical solutions.

A test signal access board includes:

a substrate layer; and a data signal access part arranged on the substrate layer and including at least two rows of conductive contacts; where the at least two rows of the conductive contacts are configured to be electrically connected with data signal test leads of a display panel, the conductive contacts in adjacent rows are arranged in a staggered manner, and a staggered pitch between the conductive contacts in adjacent rows is less than a pitch between the data signal test leads of the display panel.

In the test signal access board provided by an embodiment of the present application, the data signal access part uses at least two rows of conductive contacts to be in electrical connection with the data signal test leads of the display panel, thereby loading data test signals. Furthermore, the conductive contacts in adjacent rows are arranged in a staggered manner, such that when a certain conductive contact or a certain row of conductive contacts make poor contact with the data signal test leads, other rows of staggered contacts can make contact with the data signal test leads, thereby complementing signal input on the leads of the display panel and avoiding the occurrence of pin miss.

In summary, according to the test signal access board provided by the embodiment of the preset application, the occurrence of pin miss can be avoided, the efficiency of defect detection by Cell Test is improved, and further the accuracy of lighting test and detection is improved; and in addition, the test signal access solution of the present application does not require the use of a trimming device to remove shorting lines, thereby avoiding the influences such as high occurrences of false X-line caused by trimming residues/foreign objects, and poor cutting so as to increase the yield of display module products.

Optionally, a pitch between adjacent conductive contacts in each row of the conductive contacts is less than or equal to the pitch between the data signal test leads of the display panel.

Optionally, the test signal access board includes four rows of the conductive contacts, odd rows of the conductive contacts are arranged in an alignment manner, and even rows of the conductive contacts are arranged in an alignment manner.

Optionally, the data signal access part further includes a conductive layer, and the conductive layer is arranged on the substrate layer and is an integral layer structure; and the at least two rows of conductive contacts are arranged on the conductive layer.

Optionally, the test signal access board further includes at least two data signal access leads arranged on the substrate layer; and the conductive layer is electrically connected with any one or several of the at least two data signal access leads.

Optionally, the conductive layer is electrically connected with two of the data signal access leads.

Optionally, the conductive layer includes hollow parts.

Optionally, the conductive layer includes a first portion and a second portion; the at least two data signal access leads are located on a side, away from the first portion, of the second portion, and are connected with the second portion;

the at least two rows of conductive contacts are located in the first portion; and the hollow parts are located in the second portion.

Optionally, the conductive layer includes a row of square hollow parts, which are arranged in the same direction as each row of the conductive contacts.

Optionally, the first portion of the conductive layer includes an effective region and two buffer regions; the effective region is configured to be opposite to the data signal test leads of the display panel; and the buffer regions are located on two opposite sides of the effective region along an arrangement direction of each row of the conductive contacts; and in the at least two rows of conductive contacts, each row of the conductive contacts pass through the effective region and extend to the two buffer regions on two sides of the effective region.

Optionally, the test signal access board further includes two gate line signal access parts on two opposite sides of the data signal access part; and the two gate line signal access parts are located at two ends of each row of the conductive contacts.

Optionally, the test signal access board is an axisymmetric structure.

A lighting jig includes a flexible printed circuit and the above any one of the test signal access boards, where the flexible printed circuit is crimped to the test signal access board.

Optionally, the lighting jig further includes a circuit board electrically connected with the flexible printed circuit, and an image generator electrically connected with the circuit board.

DETAILED DESCRIPTION OF THE EMBODIMENTS

Figure 1:
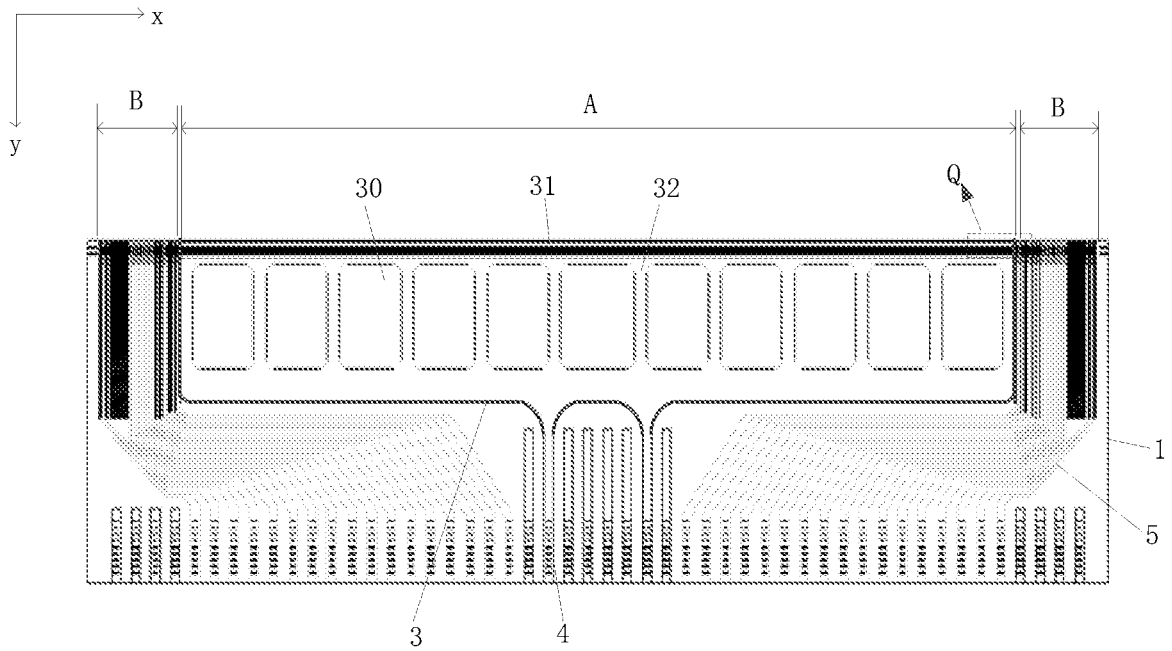
FIG. 1 is a structural schematic diagram of a test signal access board provided by an embodiment of the present application.

Currently, there are two main solutions for loading signals in Cell Test, i.e., full contact of signal leads and 2D shorting bar.

In the full contact solution, a test signal access board (block) simulates the way that a module and a flexible printed circuit are subjected to chip on film (COF) bonding, bumps on a metal film are in one-to-one crimping connection with test signal leads on a single display panel, thereby achieving single control on a single data signal. However, because a lead contact (lead pitch) is very small (generally 29 μm-40 μm), the bumps on the block also need to be made small, and pin miss easily occur in one-to-one crimping connection so as to result in lead shorting to cause bump burns, integrated circuit (IC) burns, or the like on the block; and a large number of pin miss can seriously affect defect detection by Cell Test. In addition, since a single block needs to be used on different panels, the fixed position of the pin miss cannot be guaranteed easily, thus easily resulting in false automated optical inspection (AOI) detection.

To reduce the influence of pin miss, and import an AOI device successfully, Cell Test introduces another signal loading solution, namely 2D shorting bar. The 2D shorting bar is that data signals are distinguished with two parts: DO and DE, odd number of leads and even number of leads on the panel are respectively subjected to shorting and lead to two pads, and signals are input to all the leads after signals are input to the pads. After primary inspection, a shorting line in the panel needs to be subjected to laser removal by using a trimming device to avoid influencing secondary inspection and the module. However, the higher laser energy used to laser cutting of the shorting line is prone to production of trimming residue/foreign objects to influence the product quality. In addition, the demand for ultra-narrow border products is increased in the industry, the ultra-narrow border products require a smaller pad region, and the increase in the 2D shorting line is prone to production of the high occurrences of false X-line due to cutting defects, resulting in influencing defect detection.

Therefore, the two solutions for loading signals have respective drawbacks: the full contact mode is prone to pin miss to result in signal miss, and short-circuit burns easily occur due to a small distance between test signal access board probes; and the 2D shorting bar mode requires the introduction of a trimmer for laser cutting, which easily causes the defects such as incomplete cutting and lead erosion, and there is a large investment in fixed assets for the trimmer.

In view of the problems of the above solutions for loading signals in Cell Test, the present application provides a test signal access board and a lighting jig, so as to address the above problems, improve the accuracy of lighting test and detection, and improve the defect effects in lighting test.

The technical solutions in embodiments of the present application will be clearly and fully described below in combination with the accompanying drawings in the embodiments of the present application, and obviously, the described embodiments are only some, but not all, embodiments of the present application. Based on the embodiments in the present application, all other embodiments obtained by those of ordinary skill in the art without inventive work fall within the scope of protection of the present application.

Specifically, an embodiment of the present disclosure provides a test signal access board and a lighting jig. The test signal access board is electrically connected with a display panel to load a test signal into the display panel. The lighting jig includes the test signal access board, and lights up the display panel through the test signal access board, thereby achieving Cell Test.

Figure 2:
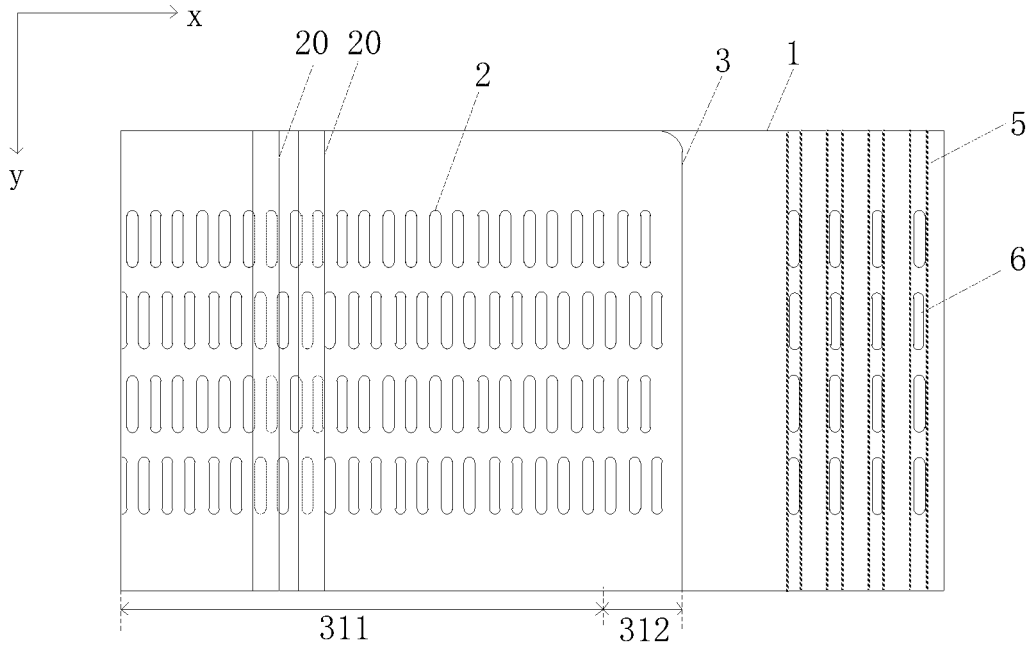
FIG. 2 is an enlarged view of a portion of FIG. 1.

Referring to FIGS. 1 and 2, FIG. 1 is a structural schematic diagram of an overall test signal access board, and FIG. 2 is an enlarged view of a portion of a region Q of FIG. 1. Since sizes of conductive contacts and a pitch between the conductive contacts are very small with respect to the entire panel, multiple rows of conductive contacts located on a first portion 31 of a conductive layer 3 in FIG. 1 appear as a black region formed by integral connection, and the specific arrangement of the conductive contacts in this region can be made with reference to the enlarged view of FIG. 2. The same is true for other black regions in FIG. 1, representing smaller and denser conductive contacts or leads. In addition, in order to illustrate the data signal loading manner between the test signal access board and the display panel, two data signal test leads 20 on the display panel are schematically drawn in FIG. 2, that is, the two data signal test leads 20 are not structures in the test signal access board of the embodiments of the present application.

As shown in FIGS. 1 and 2, the test signal access board provided by the embodiment of the present application includes a substrate layer 1 and a data signal access part A; the data signal access part A is arranged on the substrate layer 1 and includes at least two rows of conductive contacts 2 (a plurality of conductive contacts 2 arranged in a direction x are one row of conductive contacts 2, as shown in FIG. 2); the conductive contacts 2 are configured to be electrically connected with the data signal test leads 20 of the display panel; and the conductive contacts 2 in adjacent rows are arranged in a staggered manner, and a staggered pitch between the conductive contacts 2 in adjacent rows is less than a pitch between the data signal test leads 20 of the display panel.

In the test signal access board provided by the embodiment of the present application, the data signal access part A is in electrical connection with the data signal test leads 20 of the display panel by adopting at least two rows of conductive contacts, thereby loading a data test signal. Furthermore, the conductive contacts 2 in adjacent rows are arranged in a staggered manner, such that when a certain conductive contact or a certain row of conductive contacts make poor contact with the data signal test leads 20, other rows of staggered contacts can make contact with the data signal test leads 20, thereby complementing signal input on the panel leads and avoiding the occurrence of pin miss.

In summary, according to the test signal access board provided by the embodiment of the preset application, the occurrence of pin miss can be avoided, the efficiency of defect detection by Cell Test is improved, and further the accuracy of lighting test and detection is improved; and in addition, the test signal access solution of the present application does not require the use of a trimming device to remove shorting lines, thereby avoiding the influences such as high occurrences of false X-line caused by trimming residues/foreign objects, and poor cutting so as to increase the yield of display module products.

In a specific embodiment, as shown in FIG. 2, a pitch between the adjacent conductive contacts 2 in each row of the conductive contacts 2 is less than the pitch between the data signal test leads 20 of the display panel. Since a width of each of the data signal testing leads 20 is generally greater than the pitch between the adjacent data signal testing leads 20, in the embodiments of the present application, each data signal test lead 20 is in contact with at least two or at least two columns of staggered conductive contacts 2 simultaneously, thereby further guaranteeing effective access of the data test signal.

In a specific embodiment, as shown in FIG. 2, the test signal access board provided by the embodiment of the present application includes four rows of conductive contacts 2, odd rows of the conductive contacts 2 are arranged in an alignment manner and even rows of the conductive contacts 2 are arranged in an alignment manner. By such an arrangement, odd rows of the conductive contacts 2 may be arranged to form a plurality of aligned columns, even rows of the conductive contacts 2 may be arranged to form a plurality of aligned columns, and the columns formed by odd rows of the conductive contacts 2 may be staggered with the columns formed by even rows of the conductive contacts 2. In this way, the conductive contacts 2 are regularly arranged, simply patterned, and can enable the data signal test lead 20 of the display panel to be in simultaneous contact with one or several columns of the conductive contacts 2, thereby guaranteeing the effective access of the data test signal.

Specifically, as shown in FIG. 2, a direction y is a column direction of the conductive contacts 2, and the direction x is perpendicular to the direction y.

Exemplarily, as shown in FIG. 2, in the embodiment of the present application, each conductive contact 2 may be in a bar shape, specifically extend in the column direction (the direction y), thereby increasing a contact area with the data signal test leads 20 while increasing the compactness of the arrangement of the conductive contacts 2.

In a specific embodiment, as shown in FIGS. 1 and 2, the data signal access part A further includes a conductive layer 3; and the conductive layer 3 is arranged on the substrate layer 1 and is an integral layer structure. The above-mentioned at least two rows of conductive contacts 2 are arranged on the conductive layer 3.

Exemplarily, the conductive layer 3 is a metal layer. Further, the conductive contacts 2 are metal contacts; and the conductive layer 3 and the conductive contacts 2 can be an integral structure, and can be formed simultaneously by a single patterning process.

Specifically, the data test signal passes through the conductive layer 3 to reach the conductive contacts 2 and is loaded into the display panel, electrical signals loaded by all the data signal test leads 20 are the same, the output of the electrical signals with the same voltage and current onto the data signal test leads 20 can avoid the occurrence of chromatic aberrations and can require fewer matched materials for the lighting jig. For example, a shorting bar printed circuit board (PCB) designed autonomously can be used for providing electrical signals without the need for IC, PCB, T-con, and other lighting materials needed during lighting by full contact, so that the expense cost can be reduced.

In a specific embodiment, as shown in FIG. 1, the test signal access board provided by the present application further includes at least two data signal access leads 4 arranged on the substrate layer 1.

Specifically, as shown in FIG. 1, the conductive layer 3 is electrically connected with any one or several of the at least two data signal access leads 4. Further, all the data signal test leads 20 may be powered by the same one data signal access lead 4 or several data signal access leads 4.

Exemplarily, as shown in FIG. 1, the conductive layer 3 is electrically connected with the two data signal access leads 4. That is, all the data signal test leads may be powered through the two data signal access leads 4.

In a specific embodiment, as shown in FIG. 1, the conductive layer 3 comprises hollow parts 30.

Specifically, the hollow parts 30 are arranged on the conductive layer 3 to avoid problems of voltage reduction, heat generation, deformation of the conductive layer 3 or the like caused by an excessive area of the conductive layer 3 during data signal transmission.

Exemplarily, as shown in FIG. 1, the conductive layer 3 includes a first portion 31 and a second portion 32; and the data signal access leads 4 are located on a side, away from the first portion 31, of the second portion 32, and is connected with the second portion 32.

Specifically, as shown in FIGS. 1 and 2, at least two rows of conductive contacts 2 are located in the first portion 31 of the conductive layer 3; and the hollow parts 30 are located in the second portion 32 of the conductive layer 3.

Exemplarily, as shown in FIGS. 1 and 2, the conductive layer 3 includes a row of square hollow parts 30, and the row of square hollow parts 30 and each row of the conductive contacts 2 are arranged in the same direction, i.e., the direction x.

Of course, the hollow parts are not limited to be square in shape nor to be one row in number, and can be arranged according to actual requirements.

In a specific embodiment, as shown in FIGS. 1 and 2, the first portion 31 of the conductive layer 3 includes an effective region 311 and two buffer regions 312; the effective region 311 is configured to be opposite to the data signal testing leads 20 of the display panel; and in the arrangement direction of each row of the conductive contacts 2 (i.e., in the direction x), the buffer regions 312 are located on two opposite sides of the effective region 311 (only the buffer region 312 located on one side of the effective region 311 is shown in FIG. 2). As shown in FIG. 2, in the at least two rows of conductive contacts 2, each row of the conductive contacts 2 pass through the effective region 311 and extend to the two buffer regions 312 on the two sides of the effective region 311, that is, each row of the conductive contacts 2 extend to the buffer regions 312 on the two sides of the effective region 311.

Specifically, in actual operation, the conductive contacts 2 in the effective region 311 are employed to be electrically connected with the data signal testing leads 20 of the display panel; and the conductive contacts 2 are arranged in the buffer regions 312 on the two sides of the effective region 311, so as to prevent miss of edge signals caused by pin miss of the test signal access board.

Exemplarily, as shown in FIG. 2, two or three columns of conductive contacts 2 may be arranged in the buffer region 312 on each side. In this way, there will be no pin miss when great deviation occurs to the test signal access board as a whole.

In a specific embodiment, as shown in FIG. 1, the test signal access board provided by the present application further includes two gate line signal access parts B located on two opposite sides of the data signal access part A; and the two gate line signal access parts B are located at two ends of each row of the conductive contacts, that is, the two gate line signal access parts B are located at two ends of the data signal access part A in the direction x, respectively.

Specifically, as shown in FIGS. 1 and 2, the gate line signal access parts B can access signals in the manner of full contact, and specifically can include a plurality of gate line signal access leads 5 arranged side by side and conductive contacts 6 located on the gate line signal access leads 5. Exemplarily, as shown in FIG. 2, four conductive contacts 6 can be arranged at an access end of each gate line signal access lead 5, that is, each gate line signal access lead 5 is in contact with a gate line signal test lead of the display panel through the four conductive contacts 6 to be powered.

Exemplarily, as shown in FIG. 1 and FIG. 2, the substrate layer 1 may be square, the conductive contacts 2 are arranged close to a long edge of a first side of the substrate layer 1, and the data signal access leads 4 and the gate line signal access leads 5 are arranged along a long edge of a second side of the substrate layer 1, thereby facilitating electrical connection with a flexible printed circuit.

In a specific embodiment, with reference to FIG. 1, the test signal access board provided by the embodiment of the present application is an axisymmetric structure.

Specifically, in the test signal access board provided by the embodiment of the present application, GOA signal regions are arranged on two sides and a data signal region is arranged in the middle, the two GOA signal regions are designed symmetrically, the data signal region is in bilateral symmetry, and the test signal access board as a whole is in bilateral symmetry. In this way, the usage cost can be further reduced.

Specifically, during use, the display panel loads test signals through a plurality of test signal access boards, the plurality of test signal access boards are arranged from left to right along a test border (a lower border) of the display panel, where a first test signal access board is electrically connected with a GOA test lead on the left side of the display panel by using the GOA signal region on the left side, and the GOA signal region on the right side can be for standby application (dummy); the last test signal access board is electrically connected with the GOA test lead on the right side of the display panel by using the GOA signal region on the right side, and the GOA signal region on the left side can be for standby application (dummy); and for the test signal access board in the middle, the data signal region is only used, with the GOA signal regions on the two sides for standby application (dummy).

Specifically, the test signal access board provided by the embodiments of the present application has significant beneficial effects in the aspects of defect detection, equipment utilization, investment expense, and the import of an extra-large automated optical inspection device (AOI). The details are as follows.

In the aspect of defect detection: improvements in pin miss can make defect detection easier, so that the defect interception rate in Cell Test is drastically increased and the detection situation is also improved.

In the aspect of equipment utilization: by adopting the solution of the present application, the lighting environment can be significantly improved, and pin miss caused by lighting is significantly reduced, so that the time to adjust the lighting is shortened, the line changing time is shortened, and the equipment utilization is significantly improved.

In the aspect of investment expense: the data signal region employs a solution that the conductive contacts are arranged on the conductive layer and are staggered in design, and the lower portion of the conductive layer is hollow in design, so that the test signal access board cannot be damaged easily, and is easier to maintain and lower in maintenance cost. Also, the technical solution of the present application does not require a 2D Shorting line and therefore does not require investment in a trimming device, which can significantly reduce the expense of use. Furthermore, the technical solution of the present application does not require the use of IC, PCB, T-con and other lighting materials required for lighting by full contact, thereby reducing the expense.

In the aspect of the import of the extra-large AOI: AOI has extremely high requirements on the lighting effect, and does not allow the high occurrences of pin miss. Pin miss cannot be avoided in lighting by full contact, but the technical solution of the present application is able to effectively improve the pin miss condition, improve the lighting effect, provide necessary conditions for the import of AOI, and greatly increase the detection rate after the subsequent import of AOI.

Figure 3:
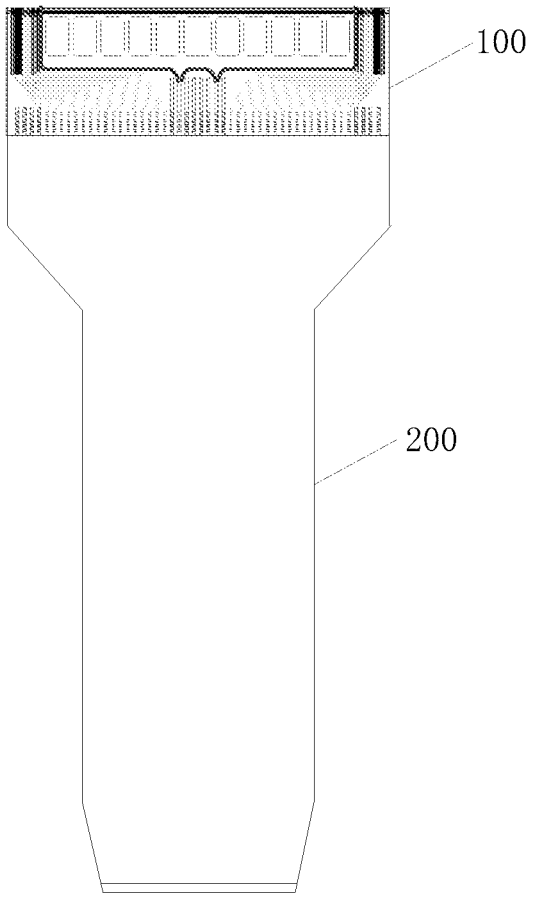
FIG. 3 is a structural schematic diagram of a lighting jig provided by an embodiment of the present application.

In addition, an embodiment of the present application also provides a lighting jig, as shown in FIG. 3, including a flexible printed circuit (FPC) 200 and any one of the above test signal access boards 100. The flexible printed circuit 200 is crimped to the test signal access board 100.

Figure 4:
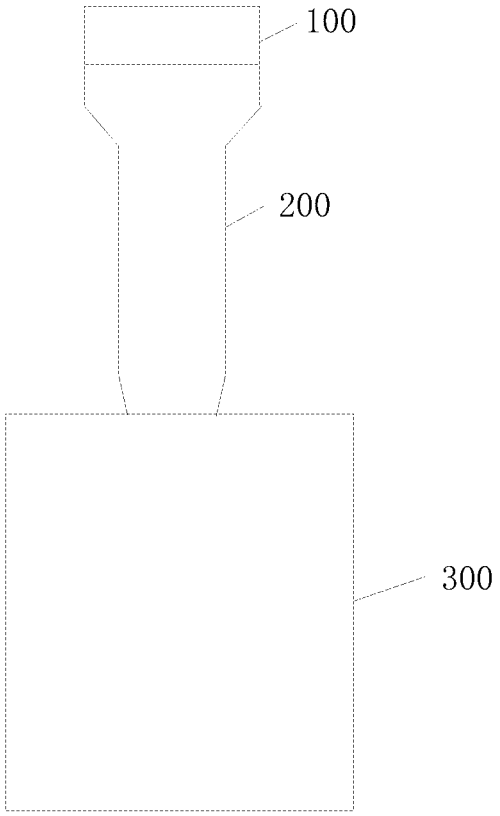
FIG. 4 is a structural schematic diagram of a lighting jig provided by another embodiment of the present application.

Further, as shown in FIG. 4, the lighting jig provided by the embodiment of the present application may further include a circuit board (PCB) 300 electrically connected with the flexible printed circuit 200, and an image generator (not shown in FIG. 4) electrically connected with the circuit board 300.

Specifically, as shown in FIG. 4, the FPC 200 includes a first electrical connection end that is crimped to the test signal access board 100, and a second electrical connection end that is connected to the PCB 300, particularly in a crimping manner.

Specifically, signals generated by the image generator are input into the PCB end, then enter the FPC, are subjected to noise reduction and voltage regulation within the FPC, then enter the test signal access board, and are loaded into the display panel through the conductive contacts on the test signal access board to achieve lighting of the display panel.

It should be noted that in some embodiments of the present application, the test signal access board and the lighting jig may also include other structures, which may be determined according to actual requirements, and may not be limited by the embodiments of the present application. In addition, the shapes and sizes of the structures provided by the embodiments of the present application are not limited to the above embodiments, and the accompanying drawings of the present application are merely exemplary in certain embodiments and do not serve as a limitation to the practical solutions of the present application.

Obviously, those skilled in the art can make various modifications and variations to the embodiments of the present application without departing from the spirit and scope of the present application. Thus, the present application intends to include these modifications and variations if these modifications and variations pertain to the scope of the appended claims and their equivalents.

What is claimed is:

1. A test signal access board, comprising:

a substrate layer; and a data signal access part arranged on the substrate layer and comprising at least two rows of conductive contacts;

wherein the at least two rows of the conductive contacts are configured to be electrically connected with data signal test leads of a display panel;

the conductive contacts in adjacent rows are arranged in a staggered manner; and a staggered pitch between the conductive contacts in adjacent rows is less than a pitch between the data signal test leads of the display panel.

2. The test signal access board of claim 1, wherein a pitch between adjacent conductive contacts in each row of the conductive contacts is less than or equal to the pitch between the data signal test leads of the display panel.

3. The test signal access board of claim 1, comprising four rows of the conductive contacts, wherein odd rows of the conductive contacts are arranged in an alignment manner, and even rows of the conductive contacts are arranged in an alignment manner.

4. The test signal access board of claim 1, wherein the data signal access part further comprises a conductive layer, and the conductive layer is arranged on the substrate layer and is an integral layer structure; and the at least two rows of conductive contacts are arranged on the conductive layer.

5. The test signal access board of claim 4, further comprising at least two data signal access leads arranged on the substrate layer;

wherein the conductive layer is electrically connected with any one or several of the at least two data signal access leads.

6. The test signal access board of claim 5, wherein the conductive layer is electrically connected with two of the data signal access leads.

7. The test signal access board of claim 5, wherein the conductive layer comprises hollow parts.

8. The test signal access board of claim 7, wherein the conductive layer comprises a first portion and a second portion;

the at least two data signal access leads are arranged on a side, away from the first portion, of the second portion, and are connected to the second portion;

the at least two rows of conductive contacts are arranged in the first portion; and the hollow parts are arranged in the second portion.

9. The test signal access board of claim 8, wherein the conductive layer comprises a row of square hollow parts, which are arranged in a same direction as each row of the conductive contacts.

10. The test signal access board of claim 8, wherein the first portion of the conductive layer comprises an effective region and two buffer regions;

the effective region is configured to be opposite to the data signal test leads of the display panel;

the buffer regions are arranged on two opposite sides of the effective region along an arrangement direction of each row of the conductive contacts; and in the at least two rows of conductive contacts, each row of the conductive contacts pass through the effective region and extend to the two buffer regions on the two sides of the effective region.

11. The test signal access board of claim 1, further comprising two gate line signal access parts arranged on two opposite sides of the data signal access part, wherein the two gate line signal access parts are arranged at two ends of each row of the conductive contacts.

12. The test signal access board of claim 1, wherein the test signal access board is an axisymmetric structure.

13. A lighting jig, comprising a flexible printed circuit and the test signal access board of claim 1, wherein the flexible printed circuit is crimped to the test signal access board.

14. The lighting jig of claim 13, further comprising:

a circuit board electrically connected with the flexible printed circuit, and an image generator electrically connected with the circuit board.

* * * * *